US005643166A

United States Patent [19]

Jarrett

[11] Patent Number: 5,643,166

[45] Date of Patent: Jul. 1, 1997

[54] APPARATUS FOR MAKING WOOD TUBING

[75] Inventor: Mark G. Jarrett, St. Clair Shores, Mich.

[73] Assignee: Hollowood, Inc., Clinton Township, Mich.

[21] Appl. No.: 507,107

[22] Filed: Jul. 26, 1995

[51] Int. Cl.[6] ..... B31C 3/00

[52] U.S. Cl. ..... 493/304; 493/301

[58] Field of Search ..... 493/269, 301, 493/303, 304, 305, 318, 319, 291, 299, 300, 302

[56] References Cited

U.S. PATENT DOCUMENTS

| | | | |
|---|---|---|---|
| 171,346 | 12/1875 | Broas | 493/304 |
| 171,347 | 12/1875 | Broas | 493/304 |
| 443,601 | 12/1890 | Maccnair | 493/304 |
| 3,528,162 | 9/1970 | Sagara | 493/304 |
| 4,121,402 | 10/1978 | Cress | 53/452 |
| 4,385,480 | 5/1983 | Burchette | 53/399 |
| 4,529,021 | 7/1985 | Shrum | 144/357 |
| 5,217,440 | 6/1993 | Frassica | 493/303 |
| 5,261,985 | 11/1993 | Lin | 493/304 |

FOREIGN PATENT DOCUMENTS

| | | | |
|---|---|---|---|
| 584489 | 9/1933 | Germany | 493/304 |

*Primary Examiner*—Joseph J. Hail, III
*Assistant Examiner*—Christopher W. Day
*Attorney, Agent, or Firm*—Gifford, Krass, Groh, Sprinkle, Patmore, Anderson & Citkowski, P.C.

[57] ABSTRACT

A tube making machine in which flat sheets of material are bent to conform with the outside surface of a cylindrical mandrel defining the interior of the tube, with bending taking place in a loop of a belt which contains the mandrel so that the material to be bend is radially compressed by the belt over a major surface of the mandrel beginning at a first line of contact where the belt first comes in contact with the mandrel and extending circumferentially to a second line of contact where the belt leaves the mandrel as the material reaches the second line of contact it is guided and maintained in contact with the mandrel until it reaches the first line of contact and reenters the space between the belt and the mandrel. The belt loop and the guide surface forms a continuous path over the entire circumference of the mandrel.

11 Claims, 5 Drawing Sheets

18
32
80
94
84
98
82
60
96
88
20
92
14
86
90
60
91
16

APPARATUS FOR MAKING WOOD TUBING

BACKGROUND OF THE INVENTION

This invention relates to machines for making tubing of multiple layers of material and more particularly to machines for making wood tubing from layers of thin wood veneer.

A variety of machines for making tubes of multiple layers of wood material have been proposed but none have been particularly effective in the production of tubing, particularly tubing of relatively small diameters and long length. Such machines typically bend the materials on a cylindrical mandrel which is supported within a loop or bight of a belt that must be moved relative to stationary support surfaces that generate friction and resistance to belts movement usually making it necessary to rotate the mandrel by power means. Also such machines attempt to keep the belt in contact with the maximum amount of the circumferential surface of the mandrel and the wood material deposited thereon but a gap is formed between the point at which the belt first contacts the mandrel and the point where the belt comes out of contact with the mandrel. In this gap, materials tend to come out of contact with the mandrel. When the materials are wood veneer, the leading edge of the veneer separates from the cylindrical surface so that when the leading edge of the veneer reenters the confines of the belt and mandrel, the veneer is usually shattered by the pressure applied by the belt. In machines where a continuous layer is wound on the mandrel the problem requires careful attention only at the beginning of the cycle of winding. The problem becomes particularly aggravated where tubes are to be made with separate, multiple layer and the leading edge of each layer must be carefully guided to reenter the feed gap between the belt and the mandrel.

SUMMARY OF THE INVENTION

It is an object of the present invention to provide a machine for making tubing in which the material to be wrapped on the mandrel is maintained in contact with a maximum portion of the circumferential surface of the mandrel.

It is another object of the invention to provide a tube making machine in which material is guided for substantially the entire circumferential surface of the mandrel on which the tube is formed to insure the material and particularly the leading edge of that material is maintained in continuous contact with the mandrel.

Still another object of the invention is to provide a tube making machine employing a belt and mandrel in which the various surfaces of the belt are supported in rolling contact as opposed to stationary surfaces to minimize power requirements to move the belt.

The machine contemplated by the present invention employs an endless belt moveable in a predetermined path and forming a loop in which a mandrel is disposed for engagement with the belt and for rotation thereby to receive material between the belt and the mandrel to radially compress the material and bend it on the mandrel to form a tube. The belt is guided to come into contact with the mandrel at a first line of contact and to remain in contact with a major portion of the circumference of the mandrel to form a material conveying path extending to a second line of contact where the belt leaves the mandrel. A shoe having a guide surface is disposed in close proximity to the surface of the mandrel to form a continuation of the material conveying path for the small remaining circumferential surface of the mandrel from the point at which the belt leaves the mandrel to the line of contact where the belt first engages the mandrel, thereby maintaining a substantially continuous material conveying path around the entire surface of the mandrel.

DETAILED DESCRIPTION

Figure 1:
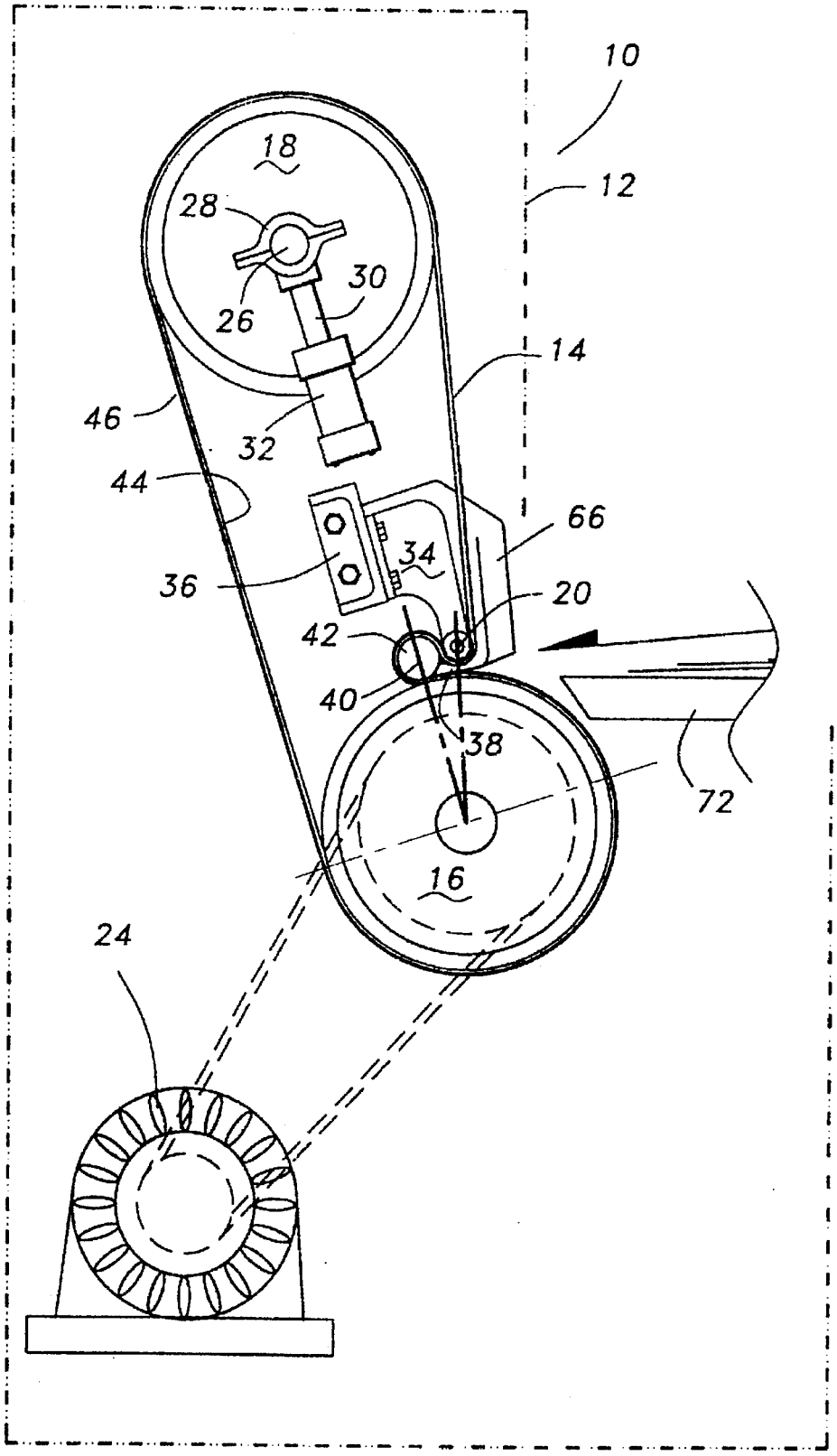
FIG. 1 is a side elevation of the principle parts of the machine embodying the invention with non-essential pans shown diagrammatically.

Apparatus embodying the invention for making tubing from flat material such as wooden tubes from flat wood veneer is illustrated in FIG. 1 and is designated generally at 10. The apparatus 10 includes a main frame indicated diagrammatically at 12. The main frame 12 supports a continuous, endless belt 14 which is trained to move over the outer surfaces of a drive or support roller 16, a tension roller 18 and an idler roller assembly 20.

The drive roller 16 is the lowest of the rollers and has a length at least as long as the tubing to be formed and is supported relative to the main frame 12 on a drive shaft 22 connected to a source of rotary power such as a motor indicated at 24.

The tension roller 18 has a length equal to the drive roller 16 and a support shaft 26, the opposite ends of which are mounted in moveable support brackets 28. The brackets 28 are movable piston rods 30 forming part of hydraulic actuators 32. The brackets 28 are mounted on the free ends of piston rods 30 so that simultaneous extension and contraction of the piston rods 30 at the opposite ends of the support shaft 26 serves to move the tension roller 18 toward and away from the drive roller 16 for adjustment of the tension of the belt 14 while maintaining the parallel relationship of the rollers 16 and 20.

The idler roller assembly is made up of a plurality of axially aligned small rollers 20 which extend of the full length of the drive and tension rollers 16 and 18. The idler rollers 20 are supported by brackets 34 fastened to a main beam 36 of the main frame 12 extending the full length of the rollers 16 and 18. The brackets 34 support the idler rollers 20 in slightly spaced relationship to the drive roller 16 to form a gap 38 which also extends the full length of the drive and tension rollers 16 and 18.

The belt 14 forms a bight or loop 40 at one side of the gap 38 which receives an elongated cylindrical mandrel 42. The mandrel 42 has an outside diameter that conforms to the inside diameter of the tube to be formed and in the preferred embodiment, is made of stainless steel. The mandrel 42, with any material which may be deposited on it, is confined within the loop 40 and its weight is supported vertically by the drive roller 16 which acts as a support means.

Upon application of rotational power to the drive roller 16 by the motor 24, the belt 14 is moved in an endless path in a generally counter-clockwise direction as viewed in FIG. 1 with the loop 40 moving in a clock-wise direction around the mandrel 42. The belt 14 leaves the tension roller 18 and moves downwardly into engagement with the drive roller 16 from which it enters the gap 38 to pass around the exterior of the mandrel 42 and any material thereon to the idler rollers 20 where it exits the gap 38 and is guided upwardly to the tension roller 18.

Figure 3:
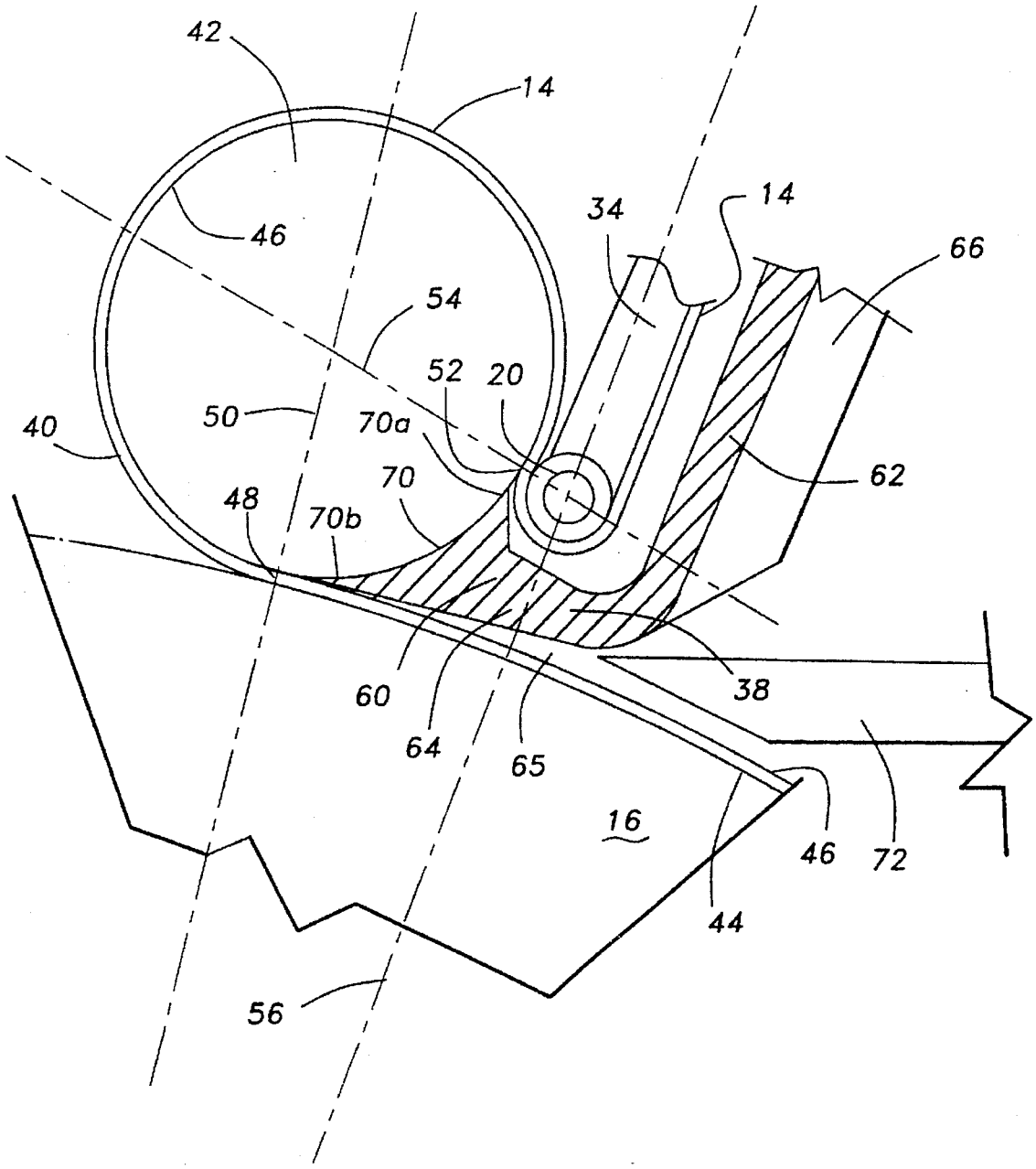
FIG. 3 is a view of a portion of the machine as seen in FIG. 1 at an enlarged scale with parts broken away.
Figure 4:
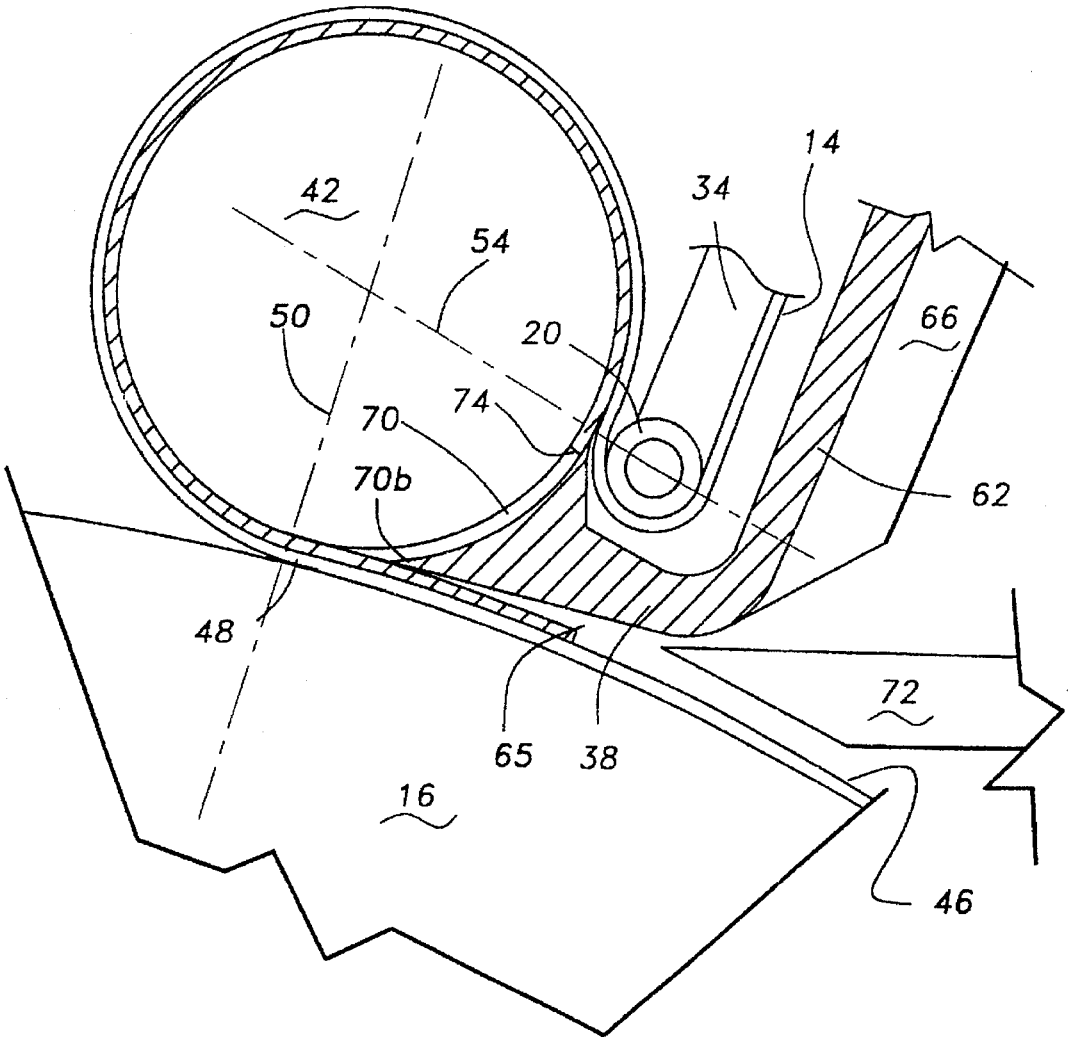
FIG. 4 is another view similar to FIG. 3 showing another condition of operation of the machine.

Referring now to FIGS. 1 and 3, the interior surface 44 of the belt 14 remains in contact with the drive roller 16 over a substantial portion of the outer circumferential surface of the drive roller 16. The belt 14 leaves the surface of the drive roller 16 to bring the opposite surface namely, the exterior surface 46 of the belt 14 into engagement with the outer surface of the mandrel 42 or any material deposited on the mandrel 42, along a line of contact 48 best seen in FIG. 3, which extends the full width of the belt 14. The line of contact 48 with the drive roller 16 and with the mandrel 42 can be defined as being in an imaginary plane designated at 50 and passing through the axis of rotation of the drive roller 16 and the mandrel 42. The line of contact 48 also can be defined as the line at which opposite surfaces of the belt 14 are tangent to both the drive roller 16 and the mandrel 42. Similarly, the belt 14 leaves the surface of the mandrel 42 or material on the mandrel 42 at another line of contact 52 which can be defined as being disposed in an imaginary plane 54 passing through the axis of rotation of both the mandrel 42 and the idler rollers 20. At the line of contact 52, the belt 14 is tangent to both the outer surface of the mandrel 42 or material thereon and the outer surface of the idler rollers 20.

The exterior surface 46 of the belt 14 which is disposed inside of the loop 40 and the outer surface of the mandrel 52 form a material conveying path between the belt 14 and mandrel 42 which extends over the circumference of the mandrel 42 from the line of contact 48 to the line of contact 52.

The gap 38 between the drive roller 16 and idler rollers 20 is formed so that the narrowest portion of the gap is disposed in an imaginary plane 56 indicated in FIG. 3 as passing through the axes of rotation of the drive roller 16 and the idler rollers 20.

The belt 14 and mandrel 42 form a material conveying path therebetween over a major portion of the outer surface of the mandrel and extending between the lines of contact 48 and 52 in the imaginary planes 50 and 54, respectively. The remainder of the circumference of the mandrel 42 which extends from the plane 54 toward the first imaginary plane 50 acts with a shoe assembly indicated at 60 to form a second material conveying path.

Figure 2:
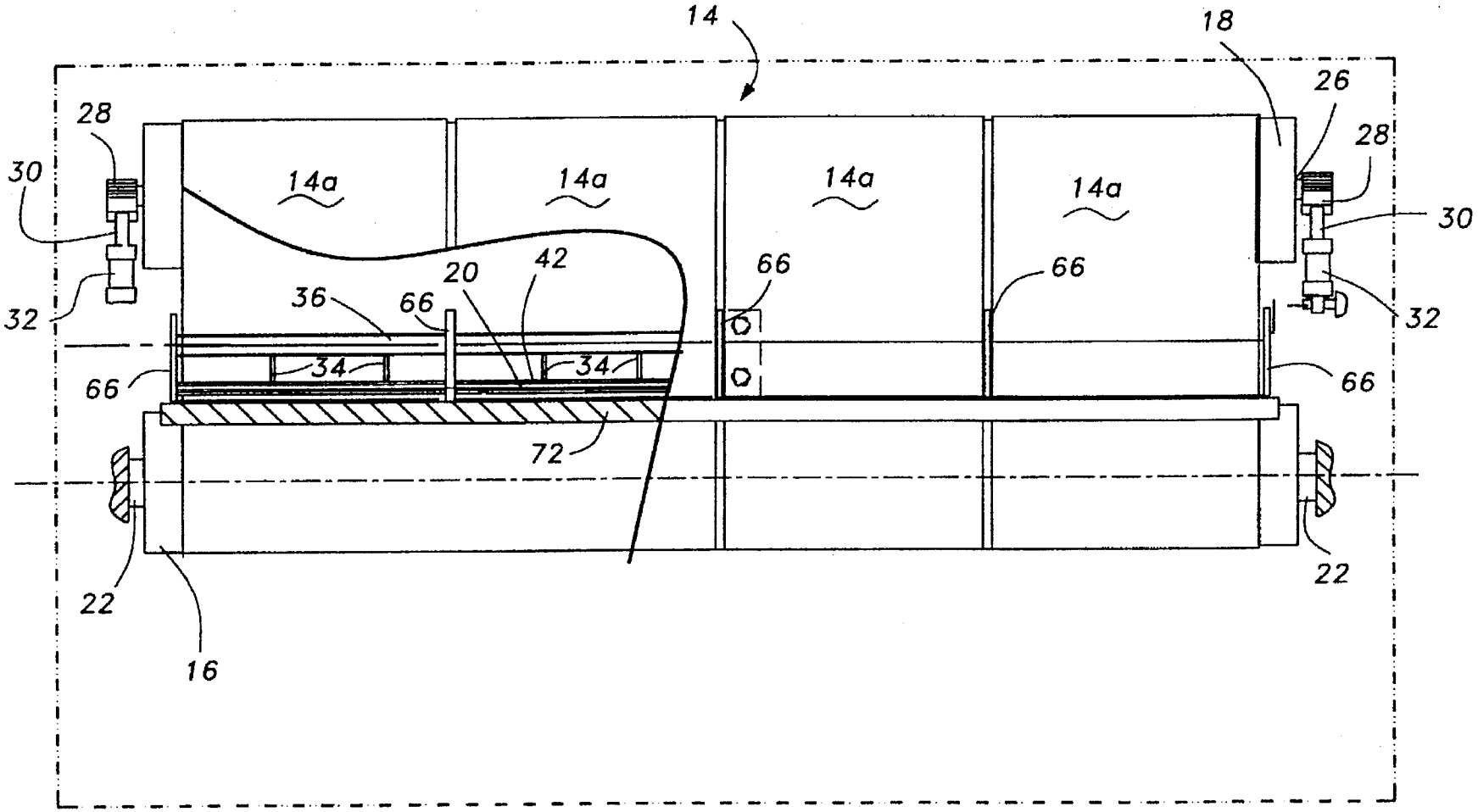
FIG. 2 is a front elevation of the machine shown in FIG. 1 with portions broken away and others shown in cross section.

The shoe assembly 60, as viewed in FIG. 3, is generally L-shaped in cross-section with a long leg 62 and a short leg 64. The shoe 60 extends the full length of the rollers 16 and 18 and the long leg 62 is fastened to brackets 66, which as best seen in FIG. 2, are disposed at the opposite ends of the belt assembly 14. The belt assembly 14 can be made up of a plurality of belt segments **14*a* in which case additional brackets 66 can pass between adjoining belt segments 14*a* to facilitate rigid support. All of the brackets 66 are attached to the main support beam 36 which extends for the full width of the machine 10**.

The short leg 64 of the shoe assembly 60 has a concave guide surface 70 which conforms generally to the cylindrical outer surface of the mandrel 42. The shoe assembly 60 is rigidly supported in fixed relation to the guide rollers 20. A sufficient space is provided at the upper surface of the short leg 64 and the outer surfaces of the idler rollers 20 to permit the belt 14 to pass freely without obstruction. The lower surface of the short leg 64 is maintained in spaced relationship to the outer belt surface 46 to form a material receiving gap 65 which is disposed generally in the belt receiving gap 38 between the drive roller 16 and the idler rollers 20 and more specifically between the lower surface of the short leg 64 and the outer surface 46 of the belt 14. The shoe assembly 60 is molded of resin and carbon fiber and the surface 70 includes graphite to minimize friction with the rotating mandrel and any material thereon.

The concave guide surface 70 is maintained in close relationship to the outer surface of the mandrel 42 and has a first edge **70*a* disposed in close proximity to the line of contact 52 and a second edge 70*b* in close proximity to the line of contact 48. The surface 70 extends circumferentially of the mandrel 42 away from the line of contact 52 and toward the line of contact 48 to complete the second portion of a material conveying path. The first portion of that material conveying path is formed by the belt 14 and the mandrel 42 between the first line of contact 48 and toward the second line of contact 52. The two material conveying paths, one formed by the belt 14 and mandrel 42 and the other by the concave surface 70 and the mandrel 42**, form a substantially continuous material conveying path.

In operation, materials such as wood veneer in flat sheet form are fed from a horizontal table 72 to the material receiving gap 65 below the short leg 64 and above the belt 14. The sheet of material is moved by the belt 14 toward the first line of contact 48 at which the flat sheet of veneer is squeezed between the belt 14 and the mandrel 42 and is bent to conform to the outer surface of the mandrel 42. The leading edge 74 of the veneer is conveyed toward the second line of contact 52 where it leaves the belt 14 to engage the concave guide surface 70. The veneer causes the mandrel 42, which is free to float, to move away from the idler rollers 20 an amount equal to the thickness of the veneer. This offers a gap between the surface 70 and mandrel 42 to receive the leading edge 74 of the veneer. The gap to receive the leading edge 74 is further enlarged to provide a small additional space between the edge **70*a* and the mandrel surface. This space typically is a fraction of the thickness of the veneer and insures that the leading edge 74 enters the conveying path defined by guide surface 70. The leading edge 74 of the veneer is engaged and guided by the concave guide surface 70 to maintain the veneer in contact with the outer surface of the mandrel 42 as it moves toward the first line of contact 48 where the material reenters the material conveying path between the belt 14 and the outer surface of the mandrel 42 at the line of contact 48. The anti friction material formed in the guide surface 70 minimizes friction between the veneer and guide surface and permits easy relative movement. In the absence of the guide surface 70, the leading edge of the veneer could move tangentially and separate from the surface of the mandrel 42. If this occurs, particularly if the wood grain is parallel to the leading edge or axis of the mandrel, the veneer tends to splinter or to be crushed when the leading edge of the veneer reenters the material conveying path at the line 48 between the belt 14 and the mandrel 42**.

After a predetermined amount of veneer has been wound on the mandrel 42 or after a desired number of layers are formed on the mandrel 42, rotation of the drive roller 16 can be stopped to bring movement of the belt 14 to a halt. Thereafter, the mandrel 42 with the layers of veneer can be removed by retracting the piston rods 30 associates with the tension roller 18. This causes the tension roller 18 to move toward the drive roller 16 so that the belt 14 becomes slack. This relieves the pressure on the mandrel 42 which can be moved axially from either end of the machine 10 to remove the mandrel 42 and the material formed on it from the loop 40. After removal of the mandrel with the layers of veneer from the machine, the mandrel 42 is extracted from the veneer leaving a tube made up of layers of wood veneer.

The ability to apply tension to the belt assembly 14 also makes it possible to retract the tension roller 18 so that mandrels 42 of slightly different diameters can be used in the machine 10.

It will be noted that the idler rollers 20 and the shoe assembly 60 are maintained in fixed relation to each other by way of mounting brackets 34 supporting the rollers 20 and mounting brackets 66 supporting the shoe assembly 60, both of which are connected to the main beam 36 of the machine 10.

The belt 14 is maintained in contact with the outer surface of the drive rollers 16 for a majority of the circumferential surface of the drive roller and as viewed in FIG. 1, it will be noted that the belt is in contact for at least 270° of the drive roller 16. This allows for a large area of frictional engagement between the drive roller 16 and belt 14 to insure belt movement without slipping and without the need for excessive tension on the belt 14.

Figure 5:
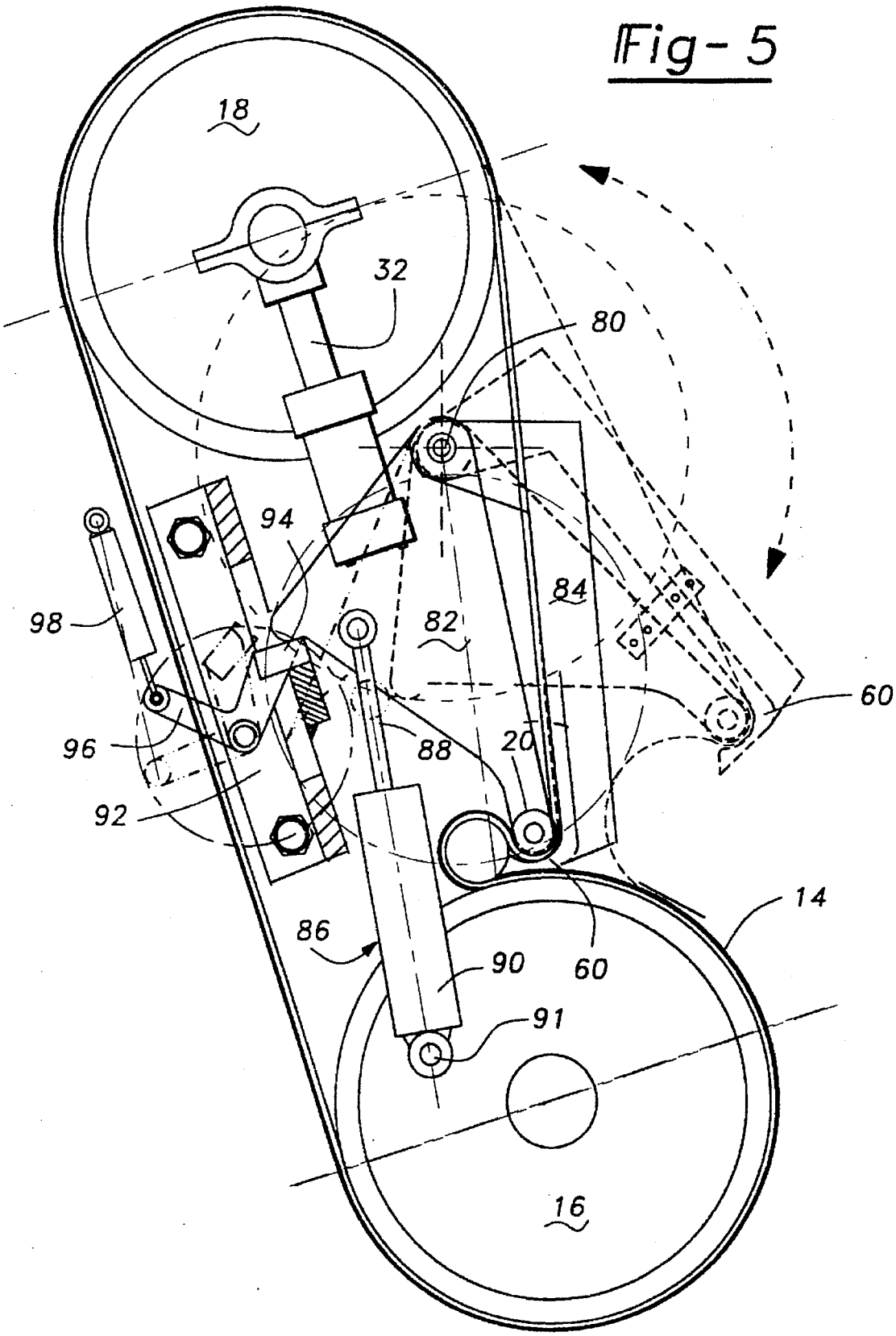
FIG. 5 is a view of another embodiment of the invention.

Referring now to FIG. 5, another embodiment of the invention is illustrated in which the idler rollers 20 and the shoe assembly 60 are mounted for swinging movement about a pivot shaft 80 as opposed to being mounted in a fixed position relative to the machine 10.

As seen in FIG. 5, the idler rollers 20 are supported on swing arms 82. The shoe assembly 60 is supported through means of brackets 84 to the swing arms 82 to maintain a fixed relationship between the shoe assembly 60 and the idler rollers 20. The swing arms 82 are mounted at their upper ends to the pivot shaft 80. The swing arms 82 at opposite ends of the machine are swingable by fluid actuators 86 having the ends of piston rods 88 pivoted to the swing arm 82 and having an end of a cylinder 90 pivotly mounted at 91 on the main frame 12 of the machine 10. To maintain the idler rollers 20 and the shoe assembly 60 in a fixed, stable position, a lock mechanism indicated generally at 92 is provided which includes a lock bar 94 supported by a bell crank 96 that can be rotated by a fluid actuator 98 from a locked position illustrated in FIG. 6 to a position away from the swing arms 82 permitting the swing arms 82 to be pivoted about the pivot shaft 80 by the fluid actuators 86.

During formation of a wooden tube by bending flat veneer material on the mandrel 42, the machine parts are positioned as illustrated in full line position in FIG. 5. After formation of a wooden tube by the placement of layers of veneer on the mandrel 42, movement of the belt 14 can be stopped and the tension roller 18 can be moved toward the drive roller 16 by retracting the actuators 32 to relieve tension on the belt 14. Thereafter fluid actuators 98 are energized to swing the lock mechanism 92 out of engagement with swing arms 82. The fluid actuators 86 can then be retracted to swing the arms 82 so that the idler rollers 20 and shoe assembly 60 are moved as a unit toward the broken line position shown in FIG. 5. In that position, the mandrel 42 is moved by the belt 14 radially from the loop 40.

To place the apparatus in readiness for formation of another tube, the mandrel 42 is placed on the belt 14 in the area where it engages the drive roller 16 so that the latter acts as a support. Thereafter, the fluid actuator 86 is extended to swing the arms 82 in a generally clockwise direction to bring the idler rollers 20 and the shoe assembly 60 from the broken line position to the full line position shown in FIG. 5. Thereafter, the lock mechanism 92 is actuated to engage swing arms 82, tension roller 18 is moved in a belt tightening direction and the new mandrel is within the loop 40 in readiness to receive additional veneer material for the formation of another tube.

In both embodiments of the invention, the arrangement of the belt 14 relative to the various rollers is such that friction is minimized by training the belt 14 over rollers and insuring that it is unnecessary for the belt to be guided by an stationary surfaces. Additionally, the mandrel 42 within the belt loop, is supported on the rotating drive roller 16 and as a result is supported by rolling surfaces which minimizes the power requirements to move the belt.

Although reference has been made to wood tubing, materials other than wood can be formed by use of the machine embodying the invention. Also, tubes of mixed materials such as layers of resin or cloth and wood may be formed.

A tube making machine has been provided in which materials are formed on a cylindrical mandrel between the mandrel and a loop of a belt and in which the material is guided between the line of contact at which the belt leaves the mandrel to the line at which the belt first contacts the mandrel so that the material conveying surface in which material is maintained in contact with the mandrel is substantially continuous about the entire circumference of the mandrel.

I claim:

1. Apparatus for forming a tube from flat material comprising:

a support roller rotatable about a first longitudinally extending axis, an idler roller rotatable about a third axis parallel to said first axis and being disposed in closely spaced relation to said support roller to form a gap, a belt trained to travel around said rollers and into and out of said gap to form a loop at one side of said gap, a cylindrical mandrel disposed in said loop for rotation by said belt about a third axis, said belt having directly opposite interior and exterior surfaces in simultaneous contact with said drive roller and with said mandrel at a line of contact disposed in a first plane passing through the said first and third axes and with said opposite interior and exterior surfaces of said belt being in simultaneous contact with said idler roller and said mandrel at a line of contact disposed in a second plane passing through said second and third axes to form a first portion of a material conveying path between said belt and said mandrel and extending from said first plane to said second plane, a shoe member disposed to extend longitudinally at one side and in fixed relation to said mandrel and forming a guide surface in proximity to said mandrel and extending circumferentially of said mandrel from said second plane toward said first plane to define a second portion of a material conveying path between said guide surface and said mandrel, said first and second material conveying paths forming a substantially continuous path around said mandrel so that flat material fed into said gap in proximity to said first plane is bent and moved through said material conveying paths around said mandrel, and said shoe and said idler roller being supported for movement as a unit to open said gap for removal of said mandrel.

2. The combination of claim 1 wherein the thickness of said material conveying path between said guide surface and said mandrel increases in response to the thickness of the material in said first material conveying path.

3. The combination of claim 1 and further comprising a third roller in rotating engagement with said belt, and means for moving said third roller to vary the tension of said belt.

4. A machine for bending layers of flat material into a tube on a cylindrical mandrel, the combination of:

an endless belt moveable in a predetermined path, a loop formed in said belt, said mandrel being disposed in said loop for engagement with said belt for rotation thereby upon movement of said belt, support means for holding said belt in engagement with said mandrel at a first line of contact, an idler roller engageable with said belt to bring said belt into contact with said mandrel at a second line of contact in spaced proximity to said support means, said loop being located at one side of said idler roller and extending between said first and second lines of contact to form a first material conveying path, a shoe extending longitudinally of said mandrel and being supported in fixed relation to said idler roller, said shoe having a guide surface extending away from said second line of contact and toward said first line of contact in proximity to said mandrel to form a second material conveying path, and a material receiving gap extending longitudinally of said mandrel and formed adjacent to said first line of contact between said belt and said mandrel to receive a layer of material and bend it on said mandrel and guide it between said mandrel and belt in said first material conveying path to said second line of contact, said second material conveying path increasing in thickness in response to the thickness of material in said first material conveying path at said second line of contact and wherein said material engages said guide surface of said shoe after passing said second line of contact for guidance of material toward said first line of contact for reentry into said gap.

5. The combination of claim 4 wherein said support means is a drive roller in contact with said belt for moving the latter.

6. The combination of claim 5 wherein said belt is maintained in driving contact with a majority of the circumferential surface of said drive roller.

7. The combination of claim 5 wherein said guide surface is concave between said lines of contact.

8. The combination of claim 4 wherein the ends of said loop are open to receive or remove said mandrel.

9. A machine for bending layers of flat material into a tube on a cylindrical mandrel, the combination of:

an endless belt moveable in a predetermined path, a loop formed in said belt, said mandrel being disposed in said loop for engagement with said belt for rotation thereby upon movement of said belt, a drive roller for holding said belt in engagement with said mandrel at a first line of contact, an idler roller engageable with said belt to bring said belt into contact with said mandrel at a second line of contact in spaced proximity to said support means, said loop located at one side of said idler roller and extending between said first and second lines of contact to form a first material conveying path, a shoe extending longitudinally of said mandrel and having a guide surface extending away from said second line of contact and toward said first line of contact in proximity to said mandrel to form a second material conveying path, and a material receiving gap extending longitudinally of said mandrel and formed adjacent to said first line of contact between said belt and said mandrel to receive a layer of material and bend it on said mandrel and guide it between said mandrel and belt in said first material conveying path to said second line of contact, and wherein said material engaging said guide surface of said shoe after passing said second line of contact for guidance of material toward said first line of contact for reentry into said gap, said idler roller and shoe being supported in fixed relation to each other for movement as a unit away from said gap to permit loading and unloading of said mandrel into said loop.

10. A machine for bending layers of flat material into a tube on a cylindrical mandrel, the combination of:

an endless belt moveable in a predetermined path, a loop formed in said belt, said mandrel being disposed in said loop for engagement with said belt for rotation thereby upon movement of said belt, a drive roller for holding said belt in engagement with said mandrel at a first line of contact, an idler roller engageable with said belt to bring said belt into contact with said mandrel at a second line of contact in spaced proximity to said first and second lines of contact to form a first material conveying path, a shoe extending longitudinally of said mandrel and having a guide surface extending away from said second line of contact and toward said first line of contact in proximity to said mandrel to form a second material conveying path, a material receiving gap extending longitudinally of said mandrel and formed adjacent to said first line of contact between said belt and said mandrel to receive a layer of material and bend it on said mandrel and guide it between said mandrel and belt in said first material conveying path to said second line of contact, and wherein said material engaging said guide surface of said shoe after passing said second line of contact for guidance of material toward said first line of contact for reentry into said gap, said belt being made up of a plurality of belt members disposed longitudinally of said mandrel in closely spaced relation to each other, and means extending between said belt members for supporting said shoe relative to said idler roller.

11. The combination of claim 10 wherein an end of said loop is open and said mandrel is movable axially into and out of said loop.

* * * * *

UNITED STATES PATENT AND TRADEMARK OFFICE

CERTIFICATE OF CORRECTION

PATENT NO. : 5,643,166

DATED : Jul. 1, 1997

INVENTOR(S) : Mark G. Jarrett

It is certified that error appears in the above-identified patent and that said Letters Patent are hereby corrected as shown below:

Column 1, line 33 - Replace "layer" with --layers--.

Column 2, line 10 - Replace "pans" with --parts--.

Column 6, line 33 - Replace "third" with --second--.

Column 6, line 43 - Replace "third" with --second--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*